US008809663B2

(12) United States Patent
Risan

(10) Patent No.: US 8,809,663 B2
(45) Date of Patent: Aug. 19, 2014

(54) SYNTHETIC SIMULATION OF A MEDIA RECORDING

(76) Inventor: Hank Risan, Santa Cruz, CA (US)

( * ) Notice: Subject to any disclaimer, the term of this patent is extended or adjusted under 35 U.S.C. 154(b) by 102 days.

(21) Appl. No.: 13/344,911

(22) Filed: Jan. 6, 2012

(65) Prior Publication Data

US 2012/0174737 A1 Jul. 12, 2012

Related U.S. Application Data

(60) Provisional application No. 61/430,485, filed on Jan. 6, 2011.

(51) Int. Cl.
*G10H 7/00* (2006.01)

(52) U.S. Cl.
USPC ..... 84/602; 84/601; 84/609; 84/616

(58) Field of Classification Search
None
See application file for complete search history.

(56) References Cited

U.S. PATENT DOCUMENTS

| | | | | |
|---|---|---|---|---|
| 5,848,165 | A * | 12/1998 | Pritchard | 381/61 |
| 6,768,046 | B2 | 7/2004 | Kriechbaum et al. | |
| 7,105,734 | B2 * | 9/2006 | Tucmandl | 84/609 |
| 7,615,702 | B2 * | 11/2009 | Becker et al. | 84/612 |
| 7,667,125 | B2 * | 2/2010 | Taub et al. | 84/616 |
| 7,847,178 | B2 * | 12/2010 | Georges | 84/645 |
| 8,183,451 | B1 * | 5/2012 | Panaiotis | 84/601 |
| 8,290,769 | B2 | 10/2012 | Taub et al. | |
| 8,497,417 | B2 | 7/2013 | Lyon et al. | |
| 2003/0188625 | A1 * | 10/2003 | Tucmandl | 84/609 |
| 2003/0188626 | A1 * | 10/2003 | Kriechbaum et al. | 84/609 |
| 2008/0300702 | A1 * | 12/2008 | Gomez et al. | 700/94 |
| 2010/0251877 | A1 * | 10/2010 | Jochelson et al. | 84/609 |
| 2011/0004467 | A1 * | 1/2011 | Taub et al. | 704/207 |
| 2012/0160078 | A1 * | 6/2012 | Lyon et al. | 84/609 |
| 2012/0174737 | A1 * | 7/2012 | Risan | 84/622 |

* cited by examiner

*Primary Examiner* — Marlon Fletcher

(57) ABSTRACT

A method and system for generating a synthetic simulation of a media recording is disclosed. One embodiment accesses a sound reference archive and heuristically creates a new sound that is matched against at least one sound in the sound reference archive. The media recording is analyzed and a synthetic sound based on the analyzing of the media recording is generated.

5 Claims, 6 Drawing Sheets

300

600

| Work Type | Copyrightable Elements | Simulation |
|---|---|---|
| Composition | | |
| | Music | v |
| | Lyrics | v |
| | Arrangement | v |
| Sound Recording | | |
| Performance | | X |
| Production | | |
| | Recording | X |
| | Processing | X |
| | Assembling | X |
| | Editing | X |
| Derivative Work | | |
| | Re-Arrangement | X |
| | Re-Mix | X |
| | Creative alteration | X |

FIG. 6

SYNTHETIC SIMULATION OF A MEDIA RECORDING

RELATED U.S. APPLICATION

This application claims priority to the copending provisional patent application Ser. No. 61/430,485, entitled "SIMULATION PROGRAM," with filing date Jan. 6, 2011, assigned to the assignee of the present application, and hereby incorporated by reference in its entirety.

FIELD

Embodiments of the present technology relates generally to the field of psychoacoustic and psychovisual simulation of a media recording.

BACKGROUND

Presently, if a user wants to buy a particular song or video, the media can be purchased and downloaded from the Internet. For example, an end user can access any of a number of media distribution sites, purchase and download the desired media and then listen or watch the media repeatedly.

SUMMARY

A method and system for generating a synthetic simulation of a media recording is disclosed. One embodiment accesses a sound reference archive and heuristically creates a new sound that is matched against at least one sound in the sound reference archive. The media recording is analyzed and a synthetic sound based on the analyzing of the media recording is generated.

BRIEF DESCRIPTION OF THE DRAWINGS

FIG. 6 is a table of one embodiment of the copyrightable subject matter in accordance with one embodiment of the present technology.

The drawings referred to in this description should be understood as not being drawn to scale except if specifically noted.

DESCRIPTION OF EMBODIMENTS

Reference will now be made in detail to embodiments of the present technology, examples of which are illustrated in the accompanying drawings. While the technology will be described in conjunction with various embodiment(s), it will be understood that they are not intended to limit the present technology to these embodiments. On the contrary, the present technology is intended to cover alternatives, modifications and equivalents, which may be included within the spirit and scope of the various embodiments as defined by the appended claims.

Furthermore, in the following description of embodiments, numerous specific details are set forth in order to provide a thorough understanding of the present technology. However, the present technology may be practiced without these specific details. In other instances, well known methods, procedures, components, and circuits have not been described in detail as not to unnecessarily obscure aspects of the present embodiments.

Overview

In general, the BlueBeat synthetic simulation of a media recording samples vintage and original instruments and voices and archived in a sound bank archive. A sound generation and spherical harmonic formulae are heuristically created and matched against the original sounds in the sound bank archive. A media recording is analyzed by a frequency analyzer which extracts a score, or parametric field, containing six parameters. The parametric field is passed to a simulation generator which takes the six parameters and generates a synthetic sound using the six parameters as canonical functions in a six dimensional parametric model derived from the sound generation and spherical harmonic formulae. The resulting bitstream represents the newly-generated synthetic sound and is placed in an .mp3 container for transport and playback.

Figure 1:
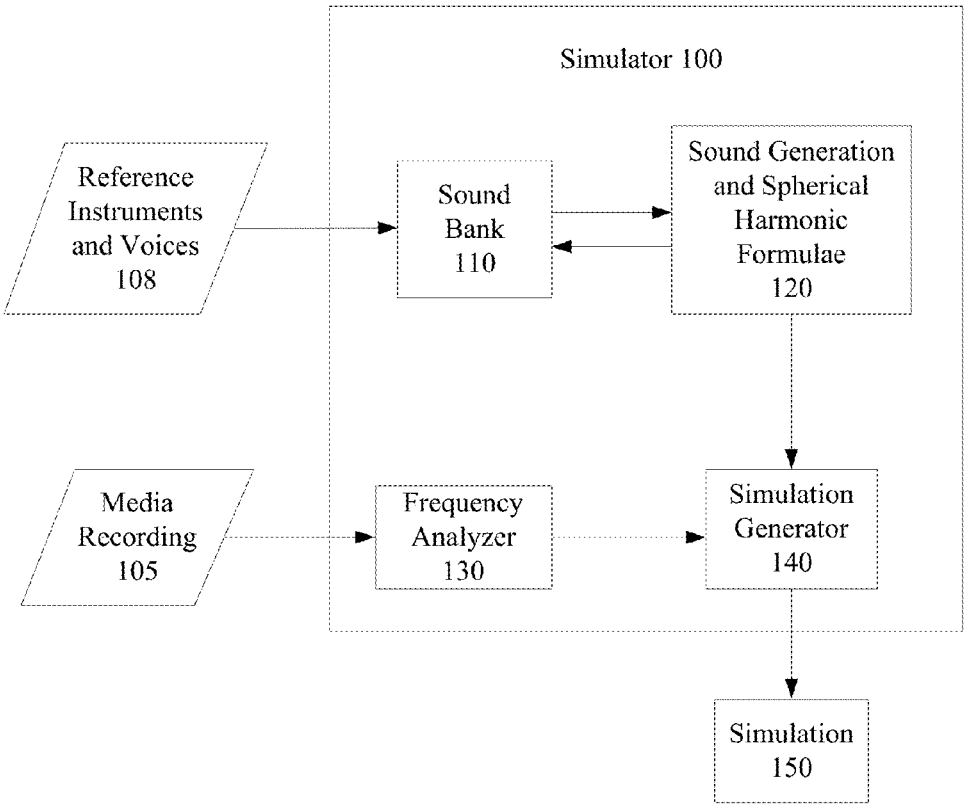
FIG. 1 is a block diagram of a synthetic media recording simulator in accordance with an embodiment of the present invention.

With reference now to FIG. 1 a block diagram of a synthetic media recording simulator is shown in accordance with an embodiment of the present invention. In one embodiment, FIG. 1 includes reference instruments and voices input 108, a media recording 105, simulator 100 and simulation 150.

Simulator 100 includes sound bank 110, sound generation and spherical harmonic formulae 120, frequency analyzer 130 and simulation generator 140.

Figure 2A:
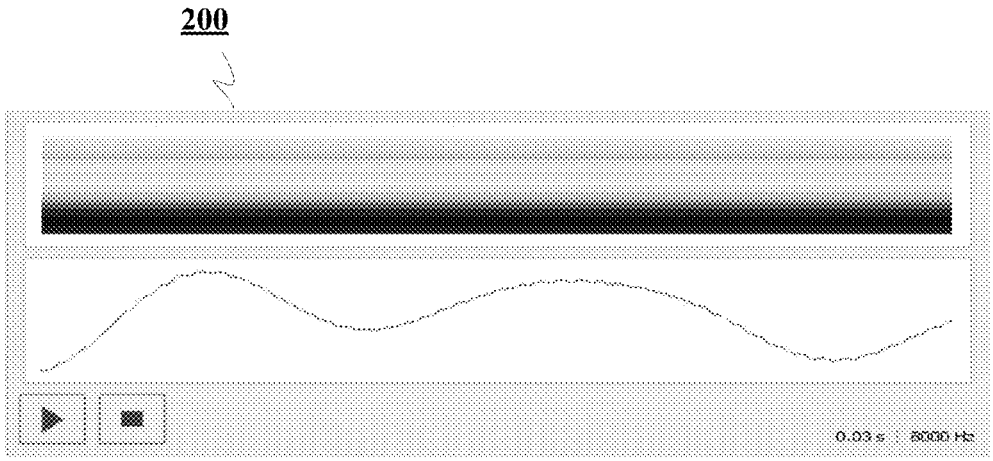
FIG. 2A is a graphical diagram of a reference sound in accordance with an embodiment of the present invention.

FIG. 2A is a graphical diagram 200 of a parametric representation of an audio sample in accordance with an embodiment of the present invention.

Figure 2B:
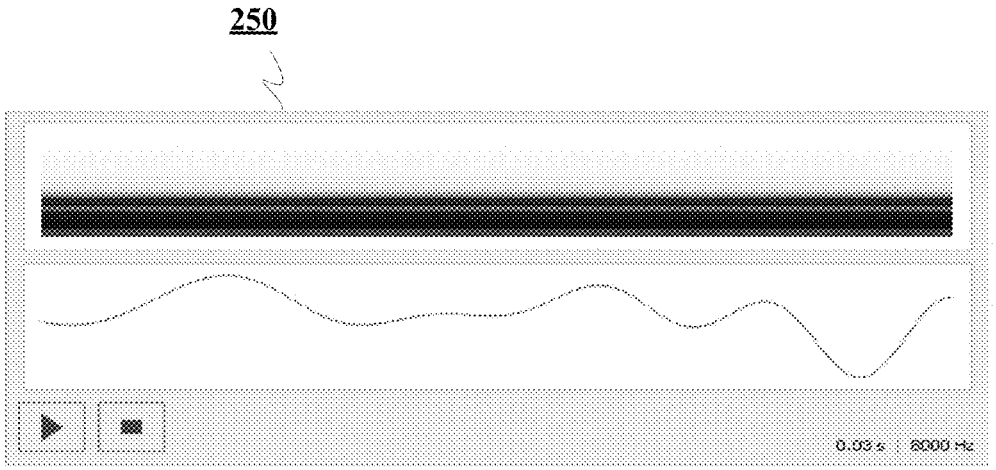
FIG. 2B is a graphical diagram of a heuristically created new sound in accordance with an embodiment of the present invention.

FIG. 2B is a graphical diagram 250 of a parametric representation of a heuristically created new sound in accordance with an embodiment of the present invention.

Figure 3:
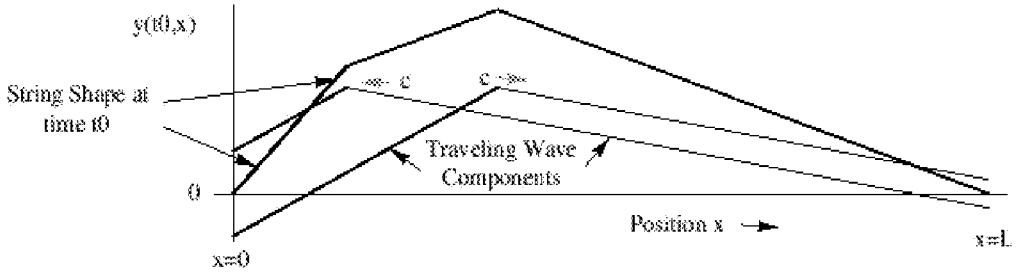
FIG. 3 is a graphical diagram of a traveling-wave component of a reference string sound in accordance with an embodiment of the present invention.

FIG. 3 is a graphical diagram 300 of a traveling-wave component of a reference string sound in accordance with an embodiment of the present invention.

Figure 4:
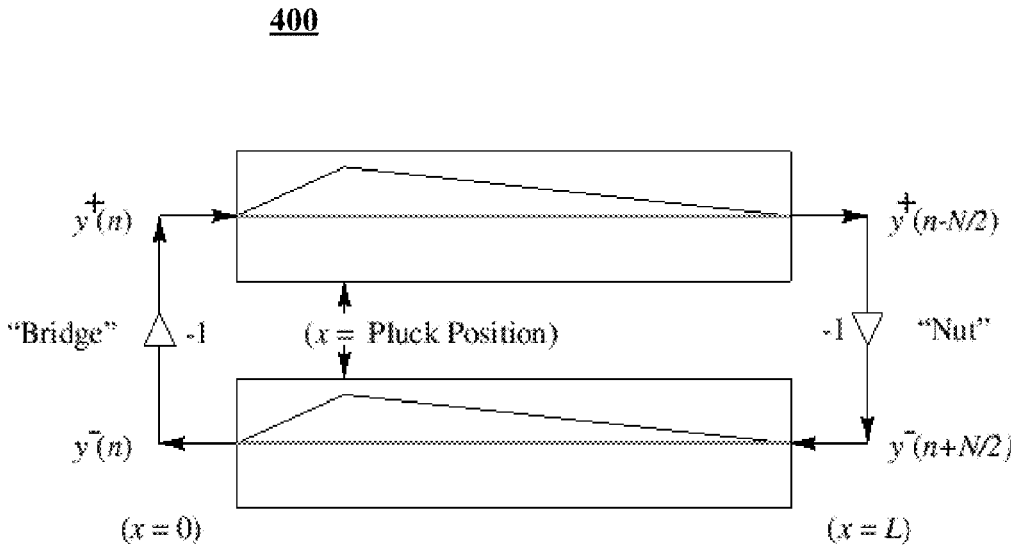
FIG. 4 is a diagram of an initial "pluck" excitation in a digital waveguide string model in accordance with an embodiment of the present invention.

FIG. 4 is a diagram 400 of an initial "pluck" excitation in a digital waveguide string model in accordance with an embodiment of the present invention. One embodiment shows the initial conditions for the ideal plucked string. In general, the initial contents of the sampled, traveling-wave delay lines are in effect plotted inside the delay-line boxes. The amplitude of each traveling-wave delay line is half the amplitude of the initial string displacement. The sum of the upper and lower delay lines gives the physical initial string displacement.

Figure 5:
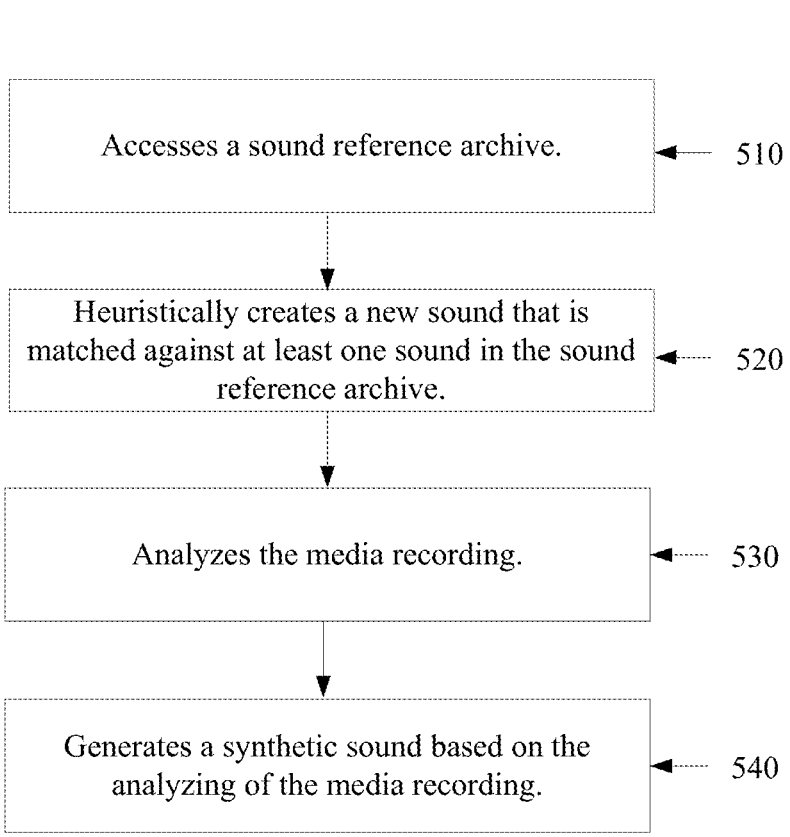
FIG. 5 is a flowchart of a method for generating a synthetic simulation of a media recording in accordance with an embodiment of the present invention.

FIG. 5 is a flowchart of a method for generating a synthetic simulation of a media recording in accordance with an embodiment of the present invention.

With reference now to 510 of FIG. 5, one embodiment accesses a sound reference archive. For example, to create the sound bank archive, thousands of vintage and original musical instruments and voices are sampled, categorized and digitally fingerprinted. This process included accessing the vintage instruments of the Museum Of Musical Instruments, which contains and has access to such historically significant instruments as Les Paul's Les Paul, as well as the guitars of Mark Twain, Django Reinhardt, Eric Clapton, Gene Autry, Mick Jagger, Woody Guthrie and countless others.

In one embodiment, the digital fingerprints are created by physically playing the instrument and recording the sounds generated, such as for example, through a microphone. However, in another embodiment, such as depending on the type and era of the instrument, the instrument would be played through and recorded by equipment appropriate to the era, to a particular artist, or the like. For example, jazz legend Charlie Christian's guitar was played would be played the same model of amplifier and microphone as used in the 1940's.

In one embodiment, depending on the type of instrument being fingerprinted and the complexity of its frequencies, between two and five samples of the instrument may be entered into sound bank 110. These samples may include individual notes, chords, progressions and riffs. In one embodiment, instruments generating more complex frequencies, such as guitars or the like, required more samples of multiple notes to capture the nuances of overlapping notes generated by the same instrument.

In one embodiment, the samples of the vintage and original instruments and voices are passed through a spectrum analyzer and saved in the sound bank 110 archive as digital .wav files. Over a period of a decade, thousands of individual instruments and voices have been analyzed and added to the sound bank 110 archive. After a critical mass of sounds was archived, sophisticated analysis of individual and groups of sounds could be performed. For example, in comparing commercially produced sound recordings (Media Recordings) to the equivalent sounds in the sound bank 110 archive, substantial variations between the sounds were found in many frequency ranges. Furthermore, different types of anomalies were detected for different musical eras.

With reference now to 520 of FIG. 5, one embodiment heuristically creates a new sound that is matched against at least one sound in the sound reference archive.

In one embodiment, sound generation and spherical harmonic formulae 120 are heuristically created to enable simulator 100 to produce a synthetic reproduction of the sounds contained in the sound bank 110. This is accomplished by synthetically reproducing a single sound contained in the sound bank 110 and comparing that synthetically reproduced sound to the reference sound in the sound bank 110. In one embodiment, the reproduction is adjusted until the synthetic reproduction sounds close to the original live instrument. Then, the synthetic reproduction is iteratively modified so that it can play another sound in the sound bank 110. This process is repeated thousands of times until sound generation and spherical harmonic formulae 120 is capable of synthetically reproducing many of the sounds in sound bank 110.

Sound Generation

In general, the sound generation portion of sound generation and spherical harmonic formulae 120 employs psychoacoustic perceptual coding techniques to model the sounds in sound bank 110. For purposes of the present description, psychoacoustics is defined as an understanding of how sound is neurologically perceived by the brain behavior and how to exploit it to improve the apparent quality of the sound to the listener.

In one embodiment, a process can be employed to produce parametric models of sounds such as shown in FIG. 2A. In one embodiment, the process may include human judgment and can produce results of acceptable quality at least for some applications. For example, as shown in 200 of FIG. 2A, a very short audio sample is constructed with an equation that produces a similar sequence of values and can be used to generate a similar sound. In the present example, the parametric representation is created by combining a series of sinc or "Mexican hat" functions additively and selecting the placement and tuning parameters of the individual functions by eye.

By visually examining audio sample 200, a replacement sound in the form of a parametric model can be created. In one embodiment, the creating of the parametric model is an individual process wherein a different modeler might very well formulate a very different representation and yet obtain a similar result. The parametric model of the musical sound simply from inspecting the original signal visually is shown in 250 of FIG. 2B. In one embodiment, the resulting sound is comparable to the original when played as an audio file.

In another embodiment, the BlueBeat simulator 100 may also use a more sophisticated model. For example, sound generation and spherical harmonic formulae 120 may be derived by reproducing the ideal plucked string. In general, the ideal plucked string is defined as an initial string displacement and a zero initial velocity distribution. More generally, the initial displacement along the string y(0,x) and the initial velocity distribution ydot(0,x), for all x, fully determine the resulting motion in the absence of further excitation.

An example of the appearance of the traveling-wave components and the resulting string shape shortly after plucking a doubly terminated string at a point one fourth along its length is shown in graph 300 of FIG. 3. The negative traveling-wave portions can be thought of as inverted reflections of the incident waves, or as doubly flipped "images" which are coming from the other side of the terminations.

An example of an initial "pluck" excitation in a digital waveguide string model is shown in diagram 400 of FIG. 4. In general, the circulating triangular components of diagram 400 are equivalent to the infinite train of initial images coming in from the left and right in graph 300.

In one embodiment, the acceleration (or curvature) waves of diagram 400 are a choice for plucked string simulation, since the ideal pluck corresponds to an initial impulse in the delay lines at the pluck point. In one embodiment, since a bandlimited excitation is utilized, the initial acceleration distribution may be replaced by the impulse response of the anti-aliasing filter chosen. If the anti-aliasing filter chosen is the ideal lowpass filter cutting off at $f_s2$, the initial acceleration $a(0,\chi) \triangleq \ddot{y}(0,\chi)$ for the ideal pluck becomes $$a(0, x) = \frac{A}{X}\operatorname{sinc}\left(\frac{x - x_p}{X}\right)$$

where A is amplitude, $\chi_p$ is the pick position, and, $[(\chi-\chi_p)/X]$ sinc is the ideal, bandlimited impulse, centered at $\chi_p$ and having a rectangular spatial frequency response extending from $-\pi/X$ to $\pi/X$. ($\operatorname{sinc}(\xi) \triangleq \sin(\pi\xi)/(\pi\xi)$). Division by X normalizes the area under the initial shape curve. If $\chi_p$ is chosen to lie exactly on a spatial sample $\chi_m = mX$, the initial conditions for the ideal plucked string are as shown for the case of acceleration or curvature waves. All initial samples are zero except one in each delay line.

In one embodiment, there are two benefits of obtaining an impulse-excited model: (1) an efficient "commuted synthesis" algorithm can be readily defined, and (2) linear prediction (and its relatives) can be readily used to calibrate the model to recordings of normally played tones on the modeled instrument. Linear predictive coding (LPC) has been used extensively in speech modeling. In general, LPC estimates the model filter coefficients under the assumption that the driving signal is spectrally flat. This assumption is valid when the input signal is (1) an impulse, or (2) white noise.

In the basic LPC model for voiced speech, a periodic impulse train excites the model filter (which functions as the vocal tract), and for unvoiced speech, white noise is used as input. In addition to plucked and struck strings, simplified bowed strings can be calibrated to recorded data as well using LPC. In this simplified model, the bowed string is approximated as a periodically plucked string.

In the BlueBeat simulation program, the ideal string formula allows for the computationally efficient generation of new sound at any frequency bandwidth, including the simulated voice of an artist, based on sounds within the sound bank 110. These sinc functions are used to generate and simulate new sounds based on sounds of the sound bank 110 after analysis and score creation.

In one embodiment, the simulated sounds thus generated by the sinc functions regain their natural timbre because they are newly generated sounds modeled on actual live sounds, without bandlimiting restrictions of the audio waveform due to limitations in recording and digitalization processes.

Spherical Harmonics

In general, the spherical harmonic portion of sound generation and spherical harmonic formulae 120 creates new point sources (origin points of the newly-created sound) for each sound in the recording. These spherical harmonics and differential equations may be driven by a set of parameters to modify the space of the sound. In one embodiment, spherical harmonic models may include spatial audio technique such as ambisonics and the like.

For example, if a musical performance is set in a virtual auditory space it may include effects such as reverberation and more generally absorption/reflection of sounds by objects in the environment. In one embodiment, a spherical harmonic generator captures (microphone capture for fixation) a generated source point of sound in a virtual 3D environment. The capture point for fixation is determined by a formulae described herein. In general, the farther the microphone was from the point of generation (source point) the sound was decreased by the inverse square law (same for sound or light).

In general, a point source produces a spherical wave in an ideal isotropic (uniform) medium such as air. Furthermore, the sound from any radiating surface can be computed as the sum of spherical wave contributions from each point on the surface (including any relevant reflections). The Huygens-Fresnel principle explains wave propagation itself as the superposition of spherical waves generated at each point along a wavefront. Thus, all linear acoustic wave propagation can be seen as a superposition of spherical traveling waves.

To obtain a good first approximation, wave energy is conserved as it propagates through the air. In a spherical pressure wave of radius r, the energy of the wavefront is spread out over the spherical surface area $4\pi r^2$. Therefore, the energy per unit area of an expanding spherical pressure wave decreases as $1/r^2$. This is called spherical spreading loss. It is also an example of an inverse square law which is found repeatedly in the physics of conserved quantities in three-dimensional space. Since energy is proportional to amplitude squared, an inverse square law for energy translates to a 1/r decay law for amplitude.

For example, the following diagram illustrates the geometry of wave propagation from a point source $x_1$ to a capture point $x_2$.

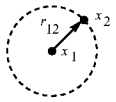

In one embodiment, the waves can be visualized as "rays" emanating from the source, and we can simulate them as a delay line along with a 1/r scaling coefficient. In contrast, since plane waves propagate with no decay at all, each "ray" can be considered lossless, and the simulation involves only a delay line with no scale factor.

For example, in a point-to-point spherical wave simulator, in addition to propagation delay, there is attenuation by g=1/r.

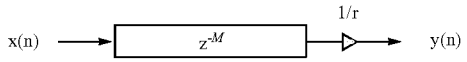

Referring now to 530 of FIG. 5, one embodiment analyzes the media recording.

In one embodiment, frequency analyzer 130 is the only point of interface with the media recording. In other words, the frequency analyzer 130 read a media recording frame by frame and created a score, or parametric field, for each frame. The frequency analyzer 130 then passed each parametric field created to the simulation generator 140. In one embodiment, the parametric field consists of six elements: pitch, timbre, speed, duration, volume and space.

In one embodiment, the media recording is read into RAM as a .wav file and frequency analyzer 130 looks at each frame and does an analysis of the frequencies contained in that frame. The frequency analyzer 130 then extracts score values for the six parameters which it passes on to the simulation generator 140. After the parameters are passed on to simulation generator 140, the buffer containing the analyzed frame is flushed and frequency analyzer 130 moved to the next frame of the .wav file resident in RAM. Additionally, after the frequency analyzer 130 reached the last frame, the last buffer was flushed.

Consequently, the media recording was never fixed or written to disk (and neither were the score parameter values of the parametric fields, which were also only processed in RAM within the Simulation Generator). In addition, it should be noted that a parametric field which is passed to simulation generator 140 is a parametric model which describes sounds as various point sources. In other words, each of the parameters of pitch, volume, timbre, spatial position, etc. generated by frequency analyzer 130 are distinctly different than a digital sampling which would have none of these parameters.

Additionally, it should be understood that only certain copyrightable elements of the media recording will be extracted from the analysis of the frequency analyzer 130 and ultimately passed on through simulator 100 to ultimately be embodied in the resulting simulation 150.

Specifically, the frame by frame synthetic reproduction will reproduce the music composition as well as the embodied lyrics and specific arrangement of the underlying composition, all of which are copyrightable elements of the composition. In other words, the music composition is essentially the score that is extracted by the frequency analyzer 130 that is played through the simulation generator 140. The copyrightable elements that are not extracted include elements pertaining to recording, such as microphone choice (BlueBeat made its own microphone choice for each instrument it sampled for the sound bank 110) and microphone placement (the simulation generator 140 makes its own determination of spatial placement). Additionally, copyrightable elements pertaining to processing such as equalization are not extracted. Therefore, the resulting simulation is that the synthetic sound is recreating a live sound based on the sound bank 110 without intervening production processing altering the sound.

FIG. 6 shows a table 600 of one embodiment of the copyrightable subject matter in accordance with one embodiment of the present technology. In general, the copyrightable subject matter of the sound recording is quite narrow as compared to the underlying music composition. Consequently, because none of the sounds in the media recording are recaptured, none of the copyrightable subject matter of the performance or production are reproduced or passed through by the frequency analyzer 130.

With reference now to 540 of FIG. 5, one embodiment generates a synthetic sound based on the analyzing of the media recording.

In one embodiment, resynthesis concerns itself with various methods of reconstructing waveforms without access to the original means of their production but rather from spectral analysis of recordings. For example, resynthesis may be used to turn old analog recordings of piano performances by a famous pianist and recreate noise free versions. In addition, spectral analysis allows for a sound to be converted into an image known as the spectrograph but it also allows for images to be converted into sounds.

In one embodiment, once a score is developed, it can be played using synthetic or synthesized instruments. For example, these instruments can be entirely synthetic or alternatively could be constructed from sampled sounds taken from real instruments different from those used in the original recording. To the extent that these sounds can be dynamically controlled, the resulting musical performance might sound nothing like the original and the final sound could be controlled and altered on demand.

In one embodiment, synthetic musical instruments may be models of simple oscillators as well as detailed physical models of specific types of instruments. Thus, the synthetic instruments are parametric and can produced sounds which will vary based on the settings of one or more control parameters.

The following example of synthesis using parametric models to resynthesize performances of a particular era is provided for clarity. Assume, a studio has received a copyright registration for its simulations of a pianists work. The studio created its simulations by analyzing a media recording of an existing performance and generating a high resolution model which is represented in a high resolution version of a MIDI file. Instead of accessing a sound bank 110 to generate the sounds digitally, the studio uses the MIDI file to drive a digital player piano, which it then records.

In the simulator 100, the frequency analyzer 130 generates a parametric field consisting of the six parameters outlined above. The simulation generator 140 then utilizes the parametric field including the six dimensional parametric model to generate a bitstream of digital audio through application of the sound generation and spherical harmonic formulae 120, which in turn was based on the data provided by the sound bank 110. The bitstream was then written to disk in an .mp3 container. After the last parametric field had been passed into the simulation generator 140 and processed, the .mp3 container was closed and the resulting simulation contained therein was ready for transport and playback. It should be noted that the simulation was not compressed using the MP3 codec, but rather the container was used so that the simulation could be played on devices that play .mp3 files.

By utilizing the technology of the simulator 100 described herein, the simulation process produces a rich smooth sound that simulates the original "live" analog waveforms produced by the actual instruments rather than the digital waveform from a CD or compressed or reformatted online music files. In addition, simulator 100 can recreate live performances. By generating sounds directly from formulae derived by reference to the original instrument, all intervening production artifacts are not present in the simulation 150.

Moreover, simulator 100 can recreate live performances that otherwise cannot be usably created due to deterioration of the media recordings. Thus, entire eras of music that have been compromised due to production techniques of that era (e.g., excessive compression of the last decade) can be heard in full dynamic range.

Furthermore, the creative potential of simulator 100 is unlimited, including allowing re-conductions of performances, re-productions of performances, and generation of entirely new performances.

The present technology may be described in the general context of computer-executable instructions stored on computer readable medium that may be executed by a computer.

Although a number of embodiments have been described in terms of music, aspects described herein may be used for any form of media, such as music, movies, videos, DVDs, CDs, books, documents, graphics, etc.

Although "accessing" has been defined in terms of playing music, transmitting music, copying music, etc., "accessing" may also included displaying copyrighted media, for example, in the case of movies, DVDs, books, graphics, and documents.

It should be further understood that the examples and embodiments pertaining to the systems and methods for disclosed herein are not meant to limit the possible implementations of the present technology. Further, although the subject matter has been described in a language specific to structural features and/or methodological acts, it is to be understood that the subject matter defined in the appended claims is not necessarily limited to the specific features or acts described above. Rather, the specific features and acts described above are disclosed as example forms of implementing the Claims.

What is claimed is:

1. A synthetic media recording simulator comprising:

a sound bank archive comprising vintage and original sounds;

a sound generation and spherical harmonic formulae to heuristically create and match new sounds against the original sounds in the sound bank archive;

a frequency analyzer which extracts a parametric field from a media recording; and a simulation generator which receives the parametric field from the frequency analyzer and generates a synthetic sound based on said sound generation and spherical harmonic formulae which is utilized for playback instead of the media recording.

2. The synthetic media recording simulator of claim 1 wherein said vintage and original sounds are instrumental sounds.

3. The synthetic media recording simulator of claim 1 wherein said vintage and original sounds are vocal sounds.

4. The synthetic media recording simulator of claim 1 wherein the parametric field contains six parameters comprising: pitch, timbre, speed, duration, volume and space.

5. The synthetic media recording simulator of claim 4 wherein the simulation generator receives the parametric field from the frequency analyzer and generates a synthetic sound using the six parameters as canonical functions in a six dimensional parametric model derived from the sound generation and spherical harmonic formulae.

* * * * *